US009272878B2

(12) United States Patent
Kocher et al.

(10) Patent No.: US 9,272,878 B2
(45) Date of Patent: Mar. 1, 2016

(54) SHAFT ACCESS ENABLING DEVICE OF AN ELEVATOR SYSTEM

(75) Inventors: Hans Kocher, Udligenswil (CH); Astrid Sonnenmoser, Ebikon (CH); David Michel, Thalwil (CH); Bjarne Lindberg, Adligenswil (CH)

(73) Assignee: Inventio AG, Hergiswil (CH)

( * ) Notice: Subject to any disclaimer, the term of this patent is extended or adjusted under 35 U.S.C. 154(b) by 838 days.

(21) Appl. No.: 13/518,082

(22) PCT Filed: Dec. 1, 2010

(86) PCT No.: PCT/EP2010/068583
§ 371 (c)(1),
(2), (4) Date: Aug. 27, 2012

(87) PCT Pub. No.: WO2011/076531
PCT Pub. Date: Jun. 30, 2011

(65) Prior Publication Data

US 2012/0305334 A1 Dec. 6, 2012

(30) Foreign Application Priority Data

Dec. 21, 2009 (EP) ..... 09180110

(51) Int. Cl.
*B66B 1/34* (2006.01)
*B66B 5/00* (2006.01)

(52) U.S. Cl.
CPC ..... *B66B 5/005* (2013.01)

(58) Field of Classification Search
CPC ..... B66B 5/005
USPC ..... 187/247, 391, 393, 395, 396, 316
See application file for complete search history.

(56) References Cited

U.S. PATENT DOCUMENTS

| | | | | |
|---|---|---|---|---|
| 5,644,111 | A * | 7/1997 | Cerny et al. | 187/393 |
| 6,202,797 | B1 * | 3/2001 | Skolnick et al. | 187/317 |
| 6,330,935 | B1 * | 12/2001 | Systermans | 187/391 |
| 6,550,585 | B2 * | 4/2003 | Schoppa et al. | 187/391 |
| 6,630,886 | B2 * | 10/2003 | Malone, Jr. | 340/540 |
| 6,847,292 | B2 * | 1/2005 | Nlabu | 340/539.1 |
| 7,364,019 | B2 * | 4/2008 | Faletto | 187/401 |
| 7,954,606 | B2 * | 6/2011 | Tinone et al. | 187/384 |
| 8,556,043 | B2 * | 10/2013 | Mangini et al. | 187/392 |
| 8,602,171 | B2 * | 12/2013 | Vogl | 187/380 |
| 8,746,415 | B2 * | 6/2014 | Aluisetti | 187/391 |
| 2012/0305340 | A1 * | 12/2012 | Wu | 187/381 |
| 2014/0069745 | A1 * | 3/2014 | Dellarippa et al. | 187/381 |

FOREIGN PATENT DOCUMENTS

| | | | |
|---|---|---|---|
| EP | 1471028 | A1 | 10/2004 |
| EP | 1882666 | A1 | 1/2008 |
| WO | 2005/095249 | A1 | 10/2005 |

* cited by examiner

*Primary Examiner* — Anthony Salata
(74) *Attorney, Agent, or Firm* — Fraser Clemens Martin & Miller LLC; William J. Clemens

(57) ABSTRACT

A shaft access enabling device of an elevator system has a shaft access control unit and at least one access monitoring unit, wherein the shaft access control unit controls an operating state of the at least one access monitoring unit and the access monitoring unit monitors at least one shaft access. The shaft access control unit has at least two different operating modes for controlling the operating state of the at least one access monitoring unit and inspects access authorization before changing between the at least two operating modes thereof.

15 Claims, 5 Drawing Sheets

SHAFT ACCESS ENABLING DEVICE OF AN ELEVATOR SYSTEM

FIELD

The invention relates to a shaft access enabling apparatus in an elevator installation.

BACKGROUND

The document EP 1 882 666 A1 discloses a method for providing surveillance for an access to an elevator car, particularly to the top or underside thereof, in an elevator installation, in which an elevator controller is switched to a servicing mode by operating an elevator car call means in a predetermined pattern.

SUMMARY

The invention is based particularly on the object of providing simple and safe surveillance for access openings in a shaft of an elevator installation, and particularly during servicing of the elevator installation.

The invention relates to a shaft access enabling apparatus in an elevator installation, having a shaft access control unit and at least one access surveillance unit, wherein the shaft access control unit is intended to control an operating state for the at least one access surveillance unit, and the access surveillance unit is intended to provide surveillance for at least one shaft access. In this context, a "control unit" is intended to be understood to mean particularly an appliance having a computation unit, a memory unit, an operating program stored therein and an application program. In this context, a "shaft access" is intended to be understood to mean particularly an opening in a shaft of an elevator installation which allow people, parts of people and/or articles which are held by people to enter a volume of space surrounded by side walls of the shaft from outside the shaft. In particular, shaft accesses include shaft doors, servicing and inspection openings and an access door to a shaft pit. In this context, "surveillance of a shaft access by an access surveillance unit" is intended to be understood to mean particularly that a shaft access has been closed using a closure means and the closure means has been locked using a locking element. By way of example, a servicing opening or a shaft door may have been closed by means of a door and may have been locked by means of an electromechanically operatable lock as a locking element. In one alternative embodiment, the servicing opening may have been locked by means of a lock which can be operated by a trihedral key as a locking element.

In addition, the access surveillance unit is intended to control a state of the locking element and/or enabling of the locking element by virtue of the access surveillance unit being able to adopt at least two operating states. The at least two operating states of the access surveillance unit are each intended to be a causal reason for the at least two states of the locking element and/or for operation of the locking element being enabled. By way of example, the two operating states of the access surveillance unit may be characterized in that a switching output of the access surveillance unit has an electrical voltage applied to it or else has no voltage, as a result of which the electromechanically operatable lock is in an unlocked or locked state.

In the alternative embodiment, the lock is in an unenabled or enabled state. In this case, the lock can be enabled in different ways. By way of example, the access to the lock, particularly the trihedral, may be covered by a blocking element in an unenabled state. By contrast, in the enabled state of the lock, the blocking element can be brought into a position which clears the access to the trihedral. Similarly, it is possible for the enabling of the lock by means of an enabling element which, in its unenabled state, prevents the trihedral from being operated by means of rotation. In this case, by way of example, the enabling element has been inserted into the rotary cylinder of the trihedral in the form of a bolt. In the enabled state of the lock, the enabling element enables the trihedral to be operated by means of rotation, for example by virtue of the enabling element having been removed from the rotary cylinder of the trihedral.

It is proposed that the shaft access control unit have at least two different modes of operation for controlling the operating state of the at least one access surveillance unit and be intended to check an access authorization prior to changing between its at least two modes of operation. In this context, "a mode of operation" of the shaft access control unit is intended to be understood to mean particularly a state of the shaft access control unit which is characterized by activation of a program sequence which is intended for a specific operating situation and comprises at least one control instruction. Preferably, the shaft access control unit may comprise one or more of the following modes of operation: normal operation, servicing, fitting, repair, evacuation. In this context, "checking an access authorization" is intended to be understood to mean particularly that the shaft access control unit compares a piece of information which is input by a user with a piece of information which is stored in an access area of the shaft access control unit. The information can be input by the user preferably by means of magnetic strips, coded keys, password input on a keypad or similar methods which are known to a person skilled in the art.

The proposed check on an access authorization prior to changing between two of the modes of operation of the shaft access control unit makes it possible to allow safe access to shaft accesses which can be determined in advance and to prevent unauthorized use of shaft accesses.

In one advantageous refinement, the shaft access enabling apparatus comprises at least two access surveillance units, wherein at least one mode of operation of the shaft access control unit has stipulated target variables which differ for operating states of the at least two access surveillance units. This advantageously allows different access options to be set up for different shaft accesses. Preferably, the target variables stipulated in the at least one mode of operation for the at least two access surveillance units may have been customized to an operating situation of the elevator installation which corresponds to this mode of operation. Advantageously, an elevator installation having multiple floors can have a no-go zone set up in it for servicing in which all shaft doors above a bottommost shaft door, by which an elevator car stays permanently, are disabled. In this way, it is possible to prevent unauthorized entry into the shaft space above the elevator car, with an associated risk of falling.

In addition, it is proposed that at least one change from at least one of the modes of operation to at least one other of the modes of operation of the shaft access control unit be taken as a basis for an information signal to leave the shaft axis control unit, which information signal is intended to actuate an elevator car drive means. Advantageously, this allows an elevator car, in a manner customized to an operating situation for the elevator installation, to adopt a position in the shaft which has been determined in advance and is stored in the memory of the shaft access control unit. Under these prerequisites, simple surveillance of shaft accesses in a zone of the elevator installation which has been determined in advance can be made possible. In this context, "at least one change is taken as a basis" is intended to be understood to mean particularly that a change is a necessary condition for output of the information signal, but it is also possible for further conditions that are to be satisfied to have been set up. Preferably, the information signal can be output by the shaft access control unit to an elevator controller, which for its part actuates an elevator car drive means in order to move the elevator car to the prescribed position.

In addition, it is proposed that at least one change from at least one of the modes of operation of the shaft access control unit to at least one other of the modes of operation is taken as a basis for an information signal to leave the shaft access control unit, which information signal is intended to actuate a locking means for mechanically obstructing an elevator car. This allows simple surveillance of an access to an area of the shaft which has been determined in advance and which is dependent on an operating situation of the elevator installation to be made possible. Preferably, the elevator car can be locked mechanically by means of the locking means using at least one guide rail, using a shaft structure or using a portion of a shaft door.

Furthermore, it is proposed that the at least one access surveillance unit comprise at least one blocking element which is intended to alter its operating state on the basis of an applied electrical voltage. This makes it possible to achieve simple, safe and controllable actuation of the at least one access surveillance unit by the shaft access control unit. Preferably, the at least one access surveillance unit may be in the form of a break contact with an electromechanical locking element, such as a lock, or in the form of an enabling apparatus according to EP 1 471 028 B1 for a trihedral key, which is customary in elevator installation engineering.

With particular advantage, the shaft access control unit has a servicing mode for controlling the operating states of the at least two access surveillance units during servicing of the elevator installation. This allows surveillance of shaft accesses to be made possible, said surveillance being attuned specifically to the increased safety requirements for servicing. In particular, enabling of shaft accesses which have been stipulated in advance and are stored in the memory of the shaft access control unit makes it possible to achieve extended options for simplified servicing of the elevator installation given a suitable design.

With particular advantage, in the servicing mode the shaft access control unit stores an "Open" operating state for an access surveillance unit for at least a bottommost shaft access and for an access surveillance unit for at least a next highest shaft access and a "Closed" operating state for all other access surveillance units. This allows unauthorized entry into the shaft space above the elevator car, with an associated risk of falling, to be prevented during servicing and allows sufficient access to be provided for performing the servicing.

If the shaft access control unit comprises at least one safety monitoring means which is intended to change a current mode of operation of the shaft access control unit to a safety mode in at least one mode of operation after a prescribed period has elapsed without control operations being requested, it is possible to achieve particularly safe access surveillance for the shaft accesses. It also allows the prevention of serious consequences of unforeseeable events, such as personal accidents or illness. In this context, "requesting control operations" is intended to be understood to mean particularly a control sequence which is requested from the shaft access control unit by input by a user. In particular, a request for a control operation can be simulated by operation of a dead man's switch. Preferably, the shaft access control unit is equipped with or has a data connection to a clock and records incoming requests for control operations in a servicing, repair or fitting mode. Preferably, the safety mode can disable all control sequences in the shaft access enabling unit and may be resectable only after a further check on an access authorization.

An elevator installation having at least one elevator car, having a shaft access enabling apparatus and having at least one further control unit is proposed which is intended to be serviced on one of the lower floors. In this context, a "lower floor" is intended to be understood to mean particularly a bottommost and a next highest floor. Bottommost floors are deemed to be floors which can be reached particularly easily in a building. Typically, they are floors which comprise an entrance area to a building, such as a ground floor or a floor which comprises an access from an above-ground or underground parking area. By virtue of the at least one further control unit being arranged and serviced on a lower floor, it is a particularly simple matter to provide safe access surveillance for the shaft accesses by means of a small number of shaft accesses that can be enabled.

If the shaft access control unit of the elevator installation stores at least two servicing positions for the at least one elevator car for the servicing of components of the elevator installation in the servicing mode, it is a particularly simple matter to provide safe surveillance of shaft accesses during servicing. Preferably, a first of the at least two servicing positions for the at least one elevator car is situated between a bottommost floor and a next highest floor. Advantageously, enabled access to shaft doors on the bottommost and next highest floors then allows components of the elevator installation which are arranged on the at least one elevator car and in the shaft pit to be amenable to servicing. In particular, suitable positioning of the at least one elevator car makes it possible to prevent a person from getting onto a roof of the at least one elevator car without authorization. Preferably, a second of the at least two servicing positions for the at least one elevator car is situated on one of the highest floors of the elevator installation. In this context, "one of the highest floors" is intended to be understood to mean particularly a highest floor and a floor situated directly beneath it. Advantageously, it is then possible to disable all shaft accesses apart from a highest shaft door and a shaft door situated directly beneath it, which allows particularly safe surveillance of the shaft accesses during servicing to be made possible.

Particularly simple and safe access surveillance for the shaft accesses during servicing can be obtained for an elevator installation having at least one elevator car and having a shaft access enabling apparatus if the elevator installation has an elevator car drive means which is intended to be arranged below a highest possible elevator car position during operation and to be serviced from the elevator car through an opening in a side wall of the elevator car. In this case, it suffices for only one shaft door, which allows access to the elevator car, to be enabled by the shaft access control unit, while all other shaft accesses are disabled by the access surveillance units.

DESCRIPTION OF THE DRAWINGS

Further advantages can be found in the descriptions of the drawings below. The drawings show exemplary embodiments of the invention. The description and the claims contain numerous features in combination. A person skilled in the art will expediently also consider the features individually and combine them to form useful further combinations.

In the drawings.

DETAILED DESCRIPTION

Figure 2:
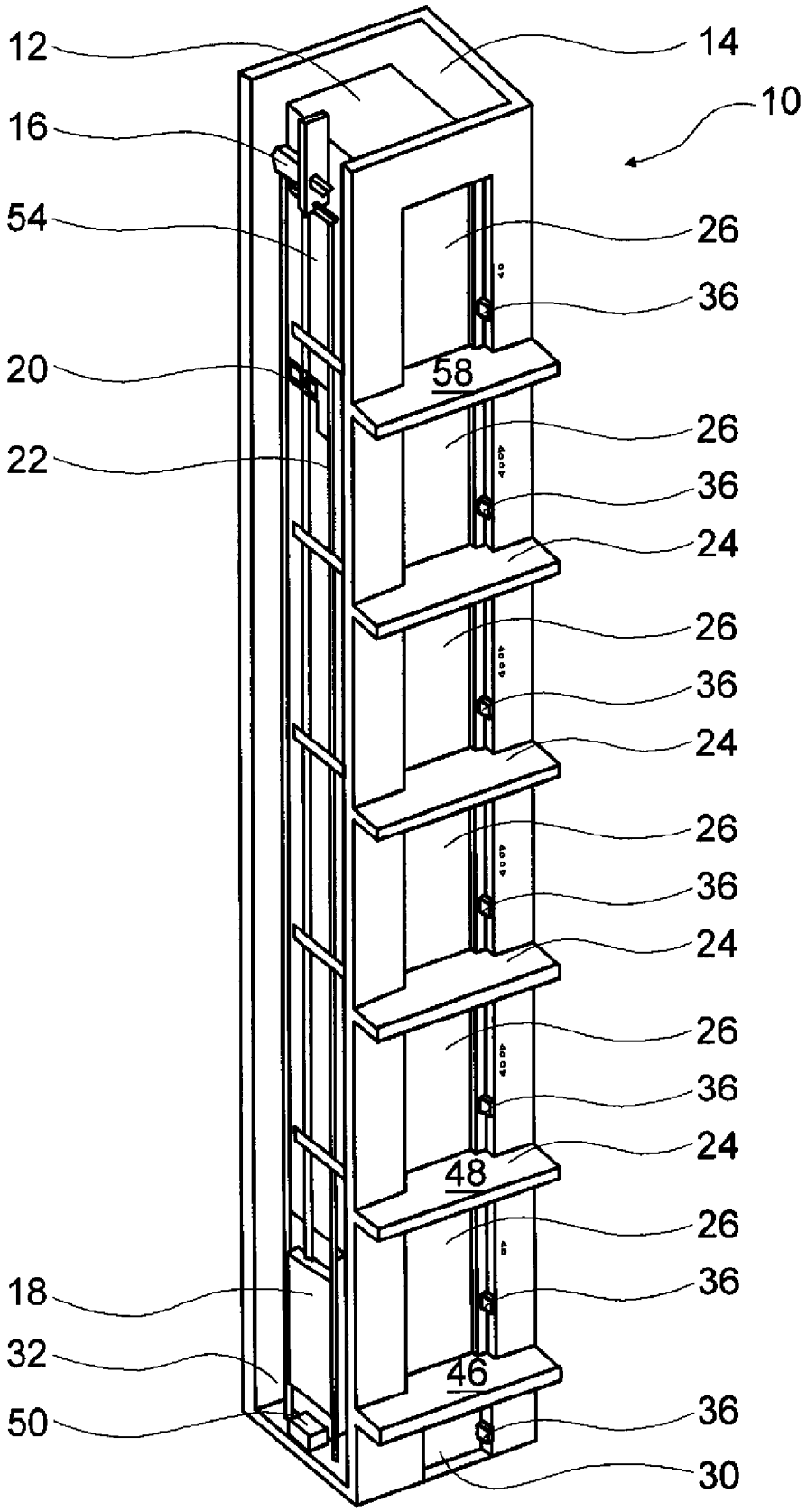
FIG. 2 shows an illustration of an elevator installation with a shaft access enabling apparatus as shown in FIG. 1.

FIG. 2 shows an elevator installation 10 with a shaft access enabling apparatus, with an elevator car 12 and with a shaft 14, in which the elevator car 12 can be moved, with a shaft pit 32. For reasons of better clarity, a wall of the shaft 14 is not shown. The elevator installation 10 comprises, in a known manner, an elevator car drive means 16, a counterweight 18 and guide rails 20, 22 for guiding the elevator car 12. On each floor 24 there is a shaft access in the form of a shaft door 26. After the elevator car 12 has approached a floor position and has stopped at a floor 24, a door 28 (FIG. 4) of the elevator car 12 opens, as a result of which the shaft door 26 on the floor 24 is likewise opened and an access to the elevator car 12 is enabled, in a known manner. Besides the shaft doors 26 on the floors 24, the elevator installation 10 comprises a shaft pit access 30 above the shaft pit 32. All shaft accesses are equipped with an auxiliary opening mechanism of a known type which is equipped with a trihedral 34 (FIGS. 4 and 5) which is accessible through an access opening and can be rotated using a trihedral key, which is customary in elevator installation engineering, in order to activate the auxiliary opening mechanism. Each shaft access in the elevator installation 10 is fitted, above the access opening for the trihedral 34, with an access surveillance unit 36 which is intended to provide surveillance for the shaft access. This is accomplished by virtue of each access surveillance unit 36 comprising a blocking element 38 (FIG. 5) which is intended to alter its operating state on the basis of an applied electrical voltage. In a first operating state of the blocking element 38, the access opening for the trihedral 34 is covered by the blocking element 38. In a second operating state, the access opening for the trihedral 34 is clear and the trihedral 34 is accessible to a user.

Alternatively, the access surveillance unit 36 comprises an enabling element instead of a blocking element 38. In this case, a rotary movement by the trihedral 34 can be enabled by the enabling element, such as a bolt, which can be inserted into and removed from a rotary cylinder of the trihedral 34. In a first operating state of the enabling element, a rotary movement by the trihedral 34 is prevented. In a second operating state, rotary operation is enabled for a user of the trihedral 34.

In a further embodiment of the elevator installation, the auxiliary opening mechanism can be operated electromechanically and, by way of example, can be designed as an electromechanically operatable lock, particularly a catch lock. In this embodiment, the trihedral 34 and also the blocking element 38 or the enabling element are dispensed with. The electromechanically operatable auxiliary opening mechanism can be operated by the access surveillance unit 36 in this case. In a first operating state of the electromechanical auxiliary opening mechanism, an associated shaft access in the form of a shaft door 26 is locked. In a second operating state, on the other hand, the associated shaft door 26 is unlocked and can be opened by a user.

The text below provides a further description of the first-mentioned embodiment of the elevator installation 10, comprising an auxiliary opening mechanism with a trihedral 34 and an access surveillance unit 36 with a blocking element 38. However, a person skilled in the art is free to, alternatively, implement the function of enabling a shaft access by means of an access surveillance unit 36 with an enabling element or by means of an electromechanically operatable auxiliary opening mechanism.

Figure 1:
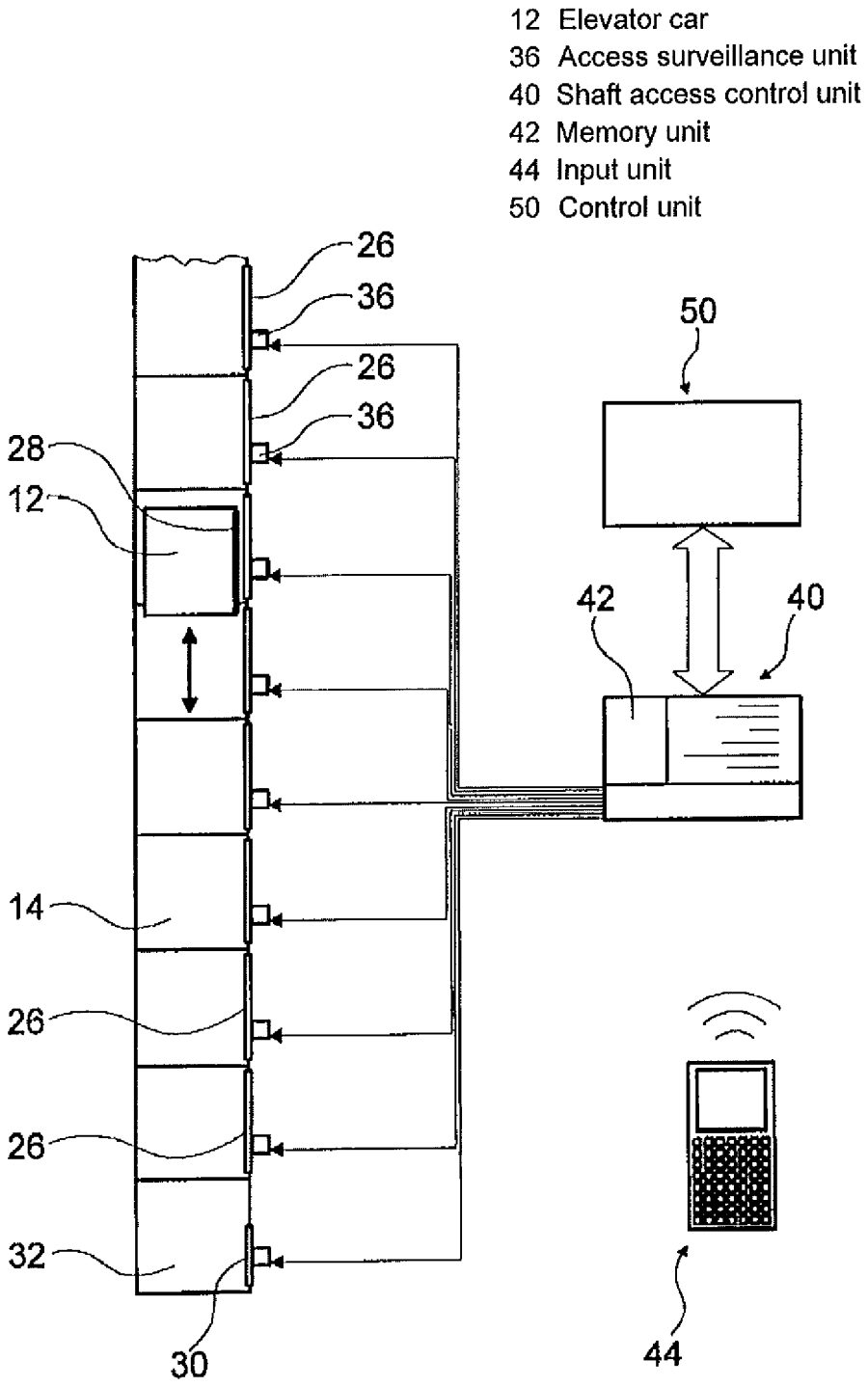
FIG. 1 shows a schematic illustration of a shaft access enabling apparatus.

FIG. 1 shows a schematic design of a shaft access enabling apparatus for the elevator installation 10 shown in FIG. 2. Besides the access surveillance units 36 (for reasons of clarity, only two access surveillance units 36 are provided with reference symbols), the shaft access enabling apparatus comprises a shaft access control unit 40 which is intended to control an operating state of each of the access surveillance units 36. The shaft access control unit 40 has the following different modes of operation for controlling the operating states of the access surveillance units 36: "normal operation" during normal operation of the elevator installation 10, "servicing" during servicing of the elevator installation 10, "repair" during replacement of a component of the elevator installation 10, "setup" during a setup phase of the elevator installation 10 and "evacuation" in the event of evacuation of the elevator installation 10. In the "normal operation" mode of operation, a memory unit 42 in the shaft access control unit 40 stores a "closed" operating state for all access surveillance units 36 as a target state. All blocking elements 38 in the access surveillance units 36 cover the respective access opening for the trihedral 34 and effectively prevent unauthorized operation of the auxiliary opening mechanism. Auxiliary opening mechanism for each mode of operation of the shaft access control unit 40, the memory unit 42 stores target states for the access surveillance units 36.

In order to prepare for servicing of the elevator installation 10, the "normal operation" mode of operation of the shaft access control unit 40 needs to be changed to the "servicing" mode of operation. The shaft access control unit 40 is intended to check an access authorization prior to changing between its modes of operation, by virtue of a user inputting a code word into a wireless input unit 44 in the shaft access control unit 40. If the input code word matches the code word stored in the memory unit 42 of the shaft access control unit 40, the unit changes to the servicing mode. In the servicing mode, differing target variables are stipulated for the operating states of the access surveillance units 36 in the memory unit 42 of the shaft access control unit 40. In the servicing mode, the shaft access control unit 40 controls the operating state of the access surveillance units 36 by virtue of the shaft access control unit 40 stipulating an "open" operating state, which is stored in the memory unit 42 of the shaft access control unit 40, for an access surveillance unit 36 for the shaft pit access 30, for an access surveillance unit 36 for the shaft door 26 on a bottommost floor 46 (FIG. 2) and for the access surveillance unit 36 for the next highest floor 48 and stipulating a "closed" operating state, which is stored in the memory unit 42 of the shaft access control unit 40, for all other access surveillance units 36.

Figure 3:
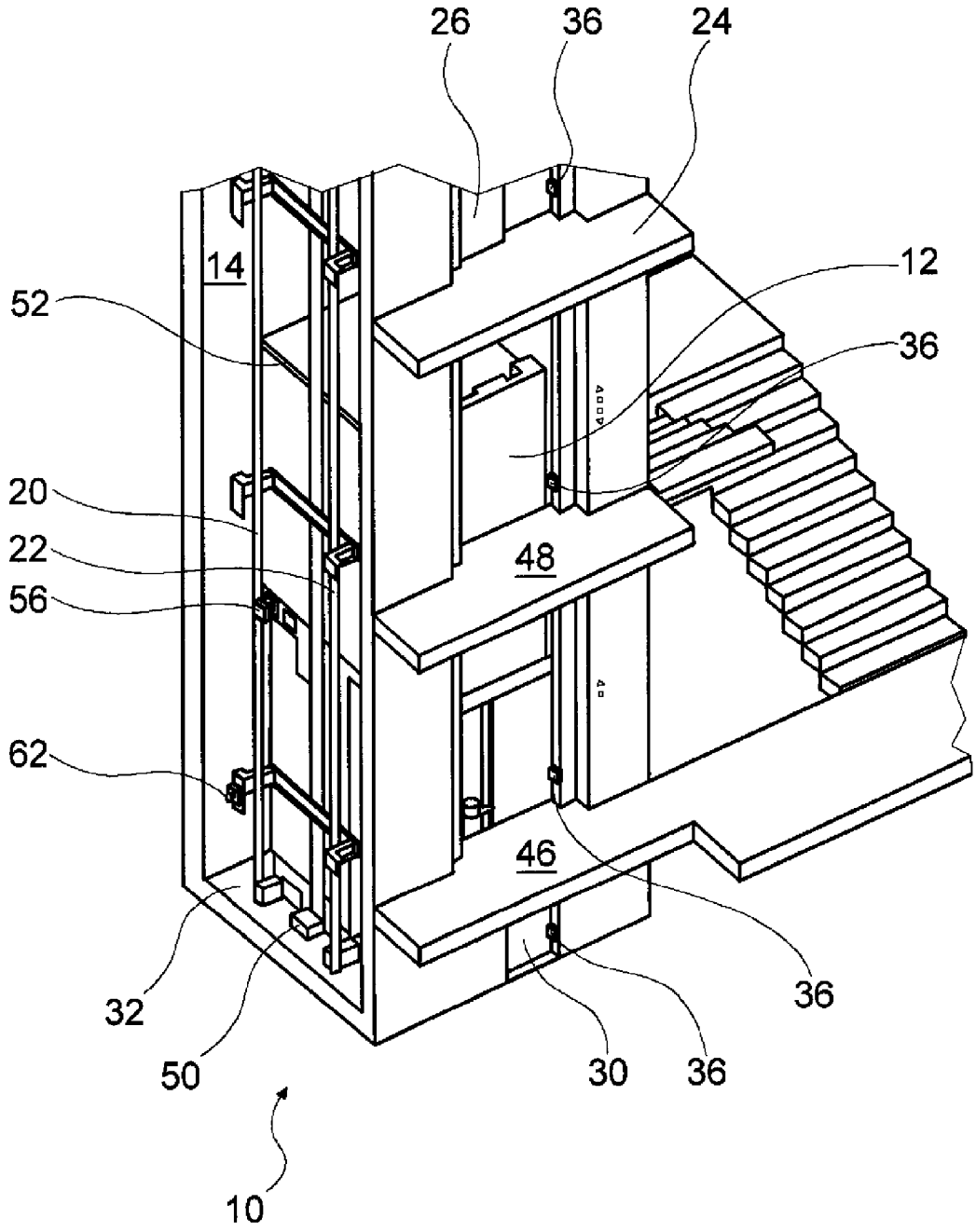
FIG. 3 shows the elevator installation shown in FIG. 2 with an elevator car in a servicing position.

The change from the "normal operation" mode of operation to the "servicing" mode of operation of the shaft access control unit 40 is taken as a basis for a first information signal to leave the shaft access control unit 40, said first information signal being intended to actuate the elevator car drive means 16. The shaft access control unit 40 sends the information signal to a control unit 50 for controlling the elevator installation 10, which control unit is intended to take the first information signal as a basis for actuating the elevator car drive means 16 and moving the elevator car 12 to one of two servicing positions 52, 54 (FIGS. 2 and 3) which are stored in the memory unit 42 of the shaft access control unit 40 for the purpose of servicing components of the elevator installation 10 in the servicing mode. Furthermore, the change from the "normal operation" mode of operation to the "servicing" mode of operation is taken as a basis for a second information signal to leave the shaft access control unit 40, said second information signal being intended to actuate a locking means 56 for mechanically obstructing the elevator car 12 (FIG. 3). The shaft access control unit 40 sends the second information signal to the control unit 50 for controlling the elevator installation 10, which control unit is intended to take the second information signal as a basis for moving the locking means 56, which is arranged on a guide rail 20, 22 in the elevator installation 10, into an obstructing position in order to mechanically obstruct the elevator car 12.

One of the two servicing positions 52, 54 of the elevator car 12 is situated between the bottommost floor 46 and the next highest floor 48 (FIG. 3). The shaft access formed by the shaft door 26 on the bottommost floor 46 can be opened using the known trihedral key, since the operating state of the access surveillance unit 36 has been changed to "open" by the shaft access control unit 40. Components of the elevator installation 10 which require servicing in the base area of the elevator car 12 can be reached through this shaft access. When the shaft door 26 of the next highest floor 48 has been opened using the trihedral key, an elevator car door drive and further components which are arranged on a roof of the elevator car 12 are accessible for servicing. The position of the elevator car 12 between the bottommost floor 46 and the next highest floor 48 has been chosen such that a gap height is produced between the roof of the elevator car 12 and the shaft door 26 which is sufficient for carrying out the servicing, but prevents a person from walking on the roof of the elevator car 12. The obstructed elevator car 12 means that there is the possibility of safely walking in the shaft pit 32 and carrying out the servicing on components of the elevator installation 10 which are arranged therein. In particular, the control unit 50 for controlling the elevator installation 10 is intended to be serviced from the bottommost floor 46 or from the shaft pit 32.

Figure 4:
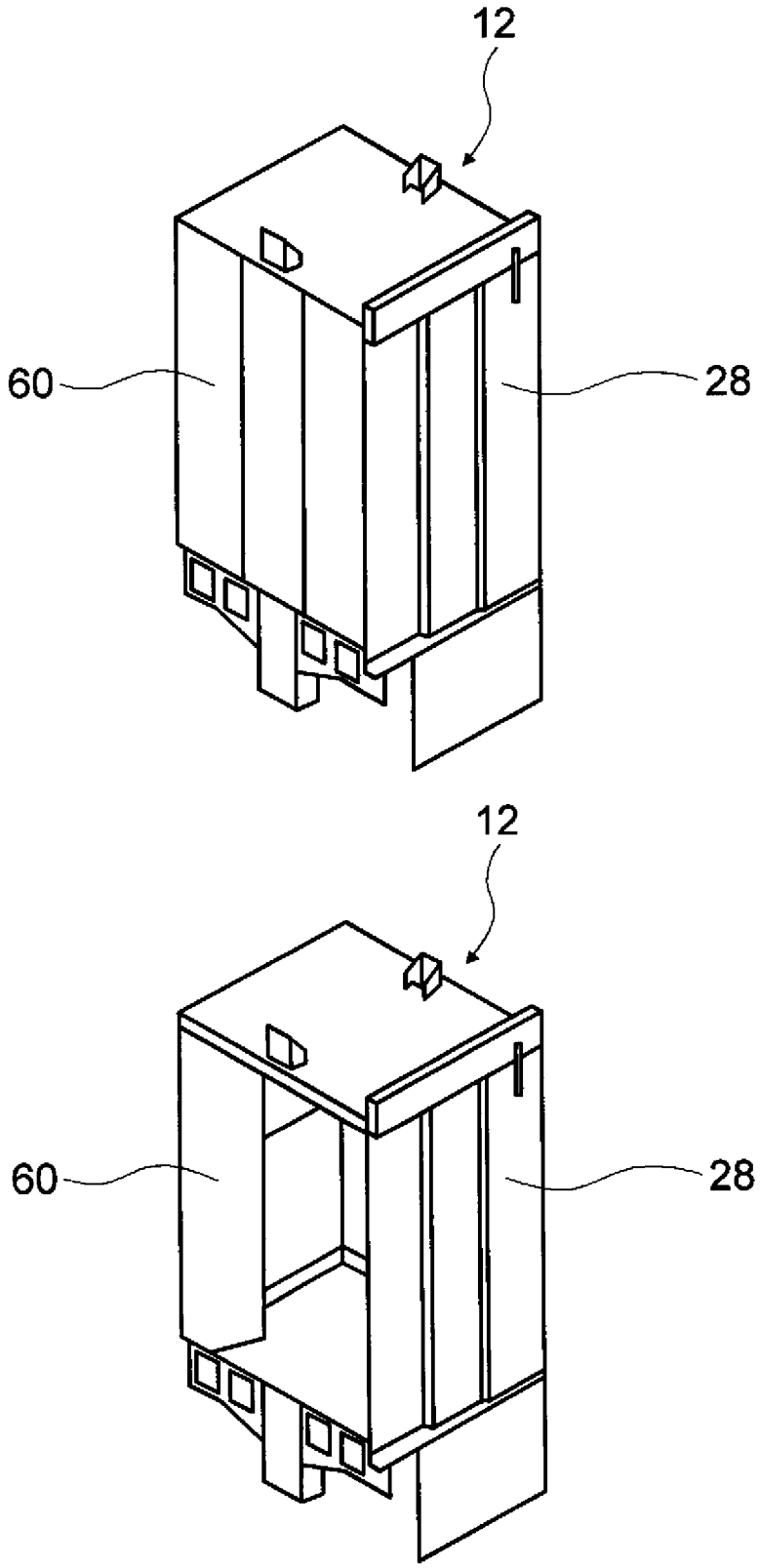
FIG. 4 shows the elevator car shown in FIG. 3 with a closed and an open side wall.
Figure 5:
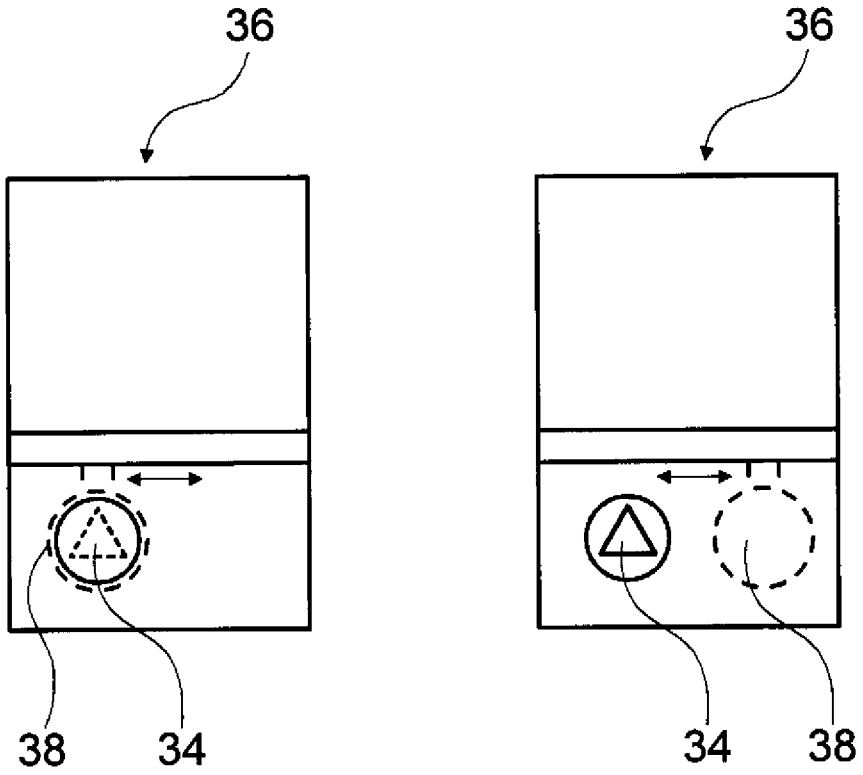
FIG. 5 shows an access surveillance unit with a covered and an open trihedral access.

The second of the two servicing positions 52, 54 of the elevator car 12 is on a topmost floor 58 of the elevator installation 10 (FIG. 2). The elevator car drive means 16 is arranged below a highest possible elevator car position during operation and is intended to be serviced from the elevator car 12 through an open side wall 60 of the elevator car 12 (FIG. 4). When the elevator car 12 has been moved to the second servicing position 54, a counterweight 18 is at a lowest point in the shaft pit 32 and can be serviced at that point without any danger.

The safe changing between two modes of operation of the shaft access control unit 40 and the associated actuation of access surveillance units 36 for enabling the trihedral 34 only for selected shaft accesses allows safe servicing. On account of the two protected elevator car positions 52, 54 for the servicing, the favorable arrangement of various components of the elevator installation 10 and the performance of servicing operations from an interior of the elevator car 12, a particular outcome, besides simple and safe surveillance of the shaft accesses, is that protective spaces that need to be provided for servicing in a known manner above and below the elevator car 12 can be dispensed with and installation space can advantageously be saved.

By using the input unit 44 of the shaft access control unit 40, the user is able to select requisite control operations for servicing. The shaft access control unit 40 has a data connection to a clock in the control unit 50 for controlling the elevator installation 10 and records incoming requests for control operations in a servicing, repair or fitting mode. The shaft access control unit 40 comprises a safety monitoring means which is intended to change the servicing mode of the shaft access control unit 40 to a safety mode when a prescribed period has elapsed in the servicing mode without any request for control operations. To avoid changing to the safety mode, the user can use the input unit 44 to request an ineffective control operation, which he is prompted to do by a signal from the shaft access control unit 40 prior to the change to the safety mode. In the safety mode of the shaft access control unit 40, all control sequences are disabled. The safety mode can be reset to another mode of operation of the shaft access control unit 40 only following a further check on the access authorization.

Resetting the servicing mode of the shaft access control unit 40 to a "normal operation" mode of operation requires the user first of all to manually operate (FIG. 3) an electrical switching element 62 which is arranged within the shaft 14 and which is provided specifically for resetting the shaft access control unit 40. In addition, within 30 seconds of the electrical switching element 62 having been operated within the shaft 14, an elevator car request needs to be made manually both on the bottommost floor 46 and on the next highest floor 48 in order to ensure that the user is outside the shaft 14 at the moment at which the shaft access control unit 40 is reset.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A shaft access enabling apparatus in an elevator installation, comprising:

at least one access surveillance unit providing surveillance for at least one shaft access of an elevator shaft; and a shaft access control unit controlling an operating state for the at least one access surveillance unit, the shaft access control unit having at least two different modes of operation for controlling the operating state of the at least one access surveillance unit and wherein the shaft access control unit checks an access authorization prior to changing between the at least two modes of operation.

2. The shaft access enabling apparatus according to claim 1 including at least two of the access surveillance unit, wherein at least one of the at least two modes of operation of the shaft access control unit has stipulated target variables which differ for operating states of the at least two access surveillance units.

3. The shaft access enabling apparatus according to claim 1 wherein at least one change from at least one of the modes of operation to at least one other of the modes of operation of the shaft access control unit generates an information signal from the shaft access control unit, which information signal actuates an elevator car drive means.

4. The shaft access enabling apparatus according to claim 1 wherein at least one change from at least one of the modes of operation of the shaft access control unit to at least one other of the modes of operation generates an information signal from the shaft access control unit, which information signal actuates a locking means for mechanically obstructing an elevator car in the elevator shaft.

5. The shaft access enabling apparatus according to claim 1 wherein the at least one access surveillance unit includes a blocking element or an enabling element that alters an operating state in response to an applied electrical voltage.

6. The shaft access enabling apparatus according to claim 1 including at least one electromechanically operatable lock operated by the at least one access surveillance unit and to alter an operating state in response to an applied electrical voltage.

7. The shaft access enabling apparatus according to claim 1 wherein the shaft access control unit has a servicing mode for controlling the operating states of at least two of the access surveillance units during servicing.

8. The shaft access enabling apparatus according to claim 7 wherein in the servicing mode the shaft access control unit stores an "Open" operating state for a one of the access surveillance units for a shaft access on at least a bottommost floor and for another of the access surveillance units for a shaft access on at least a next highest floor and a "Closed" operating state for all other access surveillance units.

9. The shaft access enabling apparatus according to claim 1 wherein the shaft access control unit includes at least one safety monitoring means that changes a current mode of operation of the shaft access control unit to a safety mode after a prescribed period has elapsed without control operations being requested.

10. An elevator installation having at least one elevator car operating in the elevator shaft and the shaft access enabling apparatus according to claim 1.

11. The elevator installation according to claim 10 wherein the shaft access control unit stores at least two servicing positions for the elevator car for servicing of components of the elevator installation in a servicing mode.

12. The elevator installation according to claim 10 including an elevator car drive means arranged below a highest possible elevator car position during operation and to be serviced from the elevator car through an opening in a side wall of the elevator car.

13. A method for operating a shaft access enabling apparatus in an elevator installation, comprising the steps of:

provide surveillance for at least one shaft access of an elevator shaft with at least one access surveillance unit;

control an operating state for the at least one access surveillance unit with a shaft access control unit, the shaft access control unit having at least two different modes of operation for controlling the operating state of the at least one access surveillance unit;

check an access authorization with the shaft access control unit prior to changing between the at least two modes of operation; and change to a requested mode of operation.

14. The method according to claim 13 including the following steps:

find for operating states of at least two of the access surveillance unit target variables which are associated with the requested mode of operation and which are stored in an access area of the shaft access control unit; and output signals which stipulate the operating state of the access surveillance units.

15. The method according to claim 13 including the following steps:

arrange a manually operated electrical switching element in the elevator shaft; and operated manually a floor call on a prescribed floor within a prescribed time after operation of the electrical switching element.

* * * * *